United States Patent [19]

Crowe

[11] 4,227,834

[45] Oct. 14, 1980

[54] BLOCK LAYING MACHINE

[75] Inventor: Robert E. Crowe, Milton, Canada

[73] Assignee: Terrafix Erosion Control Products, Inc., Rexdale, Canada

[21] Appl. No.: 3,876

[22] Filed: Jan. 16, 1979

[51] Int. Cl.[3] ..... E01C 19/52; E02B 3/12

[52] U.S. Cl. ..... 405/303; 404/99; 405/17

[58] Field of Search ..... 405/17, 146, 303; 404/99; 52/749

[56] References Cited

U.S. PATENT DOCUMENTS

| | | | |
|---|---|---|---|
| 1,339,069 | 5/1920 | Rodgers et al. | 404/99 |
| 1,527,983 | 3/1925 | Lundstrom | 404/99 |
| 1,571,386 | 2/1926 | Straight | 404/99 |
| 1,572,188 | 2/1926 | Crowell | 404/99 |
| 3,561,223 | 2/1971 | Tabor | 405/146 X |

FOREIGN PATENT DOCUMENTS

| | | | |
|---|---|---|---|
| 2511006 | 9/1976 | Fed. Rep. of Germany | 404/99 |
| 503976 | 3/1976 | U.S.S.R. | 404/99 |

*Primary Examiner*—David H. Corbin
*Attorney, Agent, or Firm*—Ridout & Maybee

[57] ABSTRACT

A machine for assisting in the laying of courses of blocks to form a ground covering layer in erosion control systems has a flexible apron on which the blocks are laid, a frame attached to one side of the apron, and two spaced and independently actuable pusher bar assemblies, which can act between the frame and the blocks to position the blocks, steer the machine, and withdraw the apron from beneath the blocks.

6 Claims, 5 Drawing Figures

BLOCK LAYING MACHINE

FIELD OF THE INVENTION

This invention relates to apparatus for laying beds of interlocking blocks, such as are used for example to cover the banks and/or beds of watercourses to control erosion.

BACKGROUND OF THE INVENTION AND PRIOR ART STATEMENT

In certain systems for erosion control, a bed of interlocking concrete blocks is laid on a filter blanket of bonded fibrous material which serves to prevent erosion of the underlying material whilst permitting the free passage of water. A characteristic of the filter blanket is a very high coefficient of friction, and this makes the blocks, which individually may weigh as much as 90 pounds, difficult to man-handle and position accurately on the mat. An object of the invention is to provide a mechanical aid to the laying and accurate positioning of such blocks, not only on such filter blankets, but also on beds of material such as sand or gravel which might be disrupted if the blocks were shifted over their surfaces.

It has been proposed to facilitate the laying of paving bricks and blocks by mechanical devices in which the bricks or blocks are laid on an apron over which they may readily be moved into position, and when several courses of bricks or blocks have been laid, a pusher bar is actuated to hold the blocks against displacement whilst the apron is partially withdrawn from beneath the blocks so that the latter are gently transferred onto a bed or blanket of material onto which they are to be laid. Such apparatus is described in U.S. Pat. No. 1,527,983 to Lundstrom and U.S. Pat. No. 1,571,386 to Straight.

The apparatus disclosed in these patents is relatively sophisticated and is intended for laying a level pavement on roadways in which the curvature will usually be slight and the camber, if any, will be relatively constant. In erosion control applications, the layer of blocks may have to follow complex contours on steep slopes, and relatively sharp bends along winding water courses, as well as abrupt changes of gradient. Moreover, a degree of flexibility in the interlocking system of blocks is required. All this requires some degree of adjustment in the relative alignment of the blocks so as to provide an interlocking layer of blocks which will follow the contours of the ground to be protected whilst maintaining a desired orientation of the blocks. These requirements cannot be met by the known apparatus, which relies on the existence of a prepared roadway to keep it on a desired alignment and is designed to produce an entirely uniform pavement.

SUMMARY OF THE INVENTION

The invention provides a machine for laying interlocking blocks on a prepared surface comprising a thin, flexible apron presenting a low frictional resistance to movement of the blocks over its upper surface and to movement of its lower surface over the prepared surface, a frame connected to one marginal edge of the apron, at least two laterally spaced pusher bars overlying the apron, and an independently operable retractable actuator acting between pusher bar and the frame and operable so as to push its associated bar and the frame apart.

Preferably the actuators are pneumatic rams, and there are articulated connecting between the apron and the frame, the frame and actuators, and the actuators and the pusher bars so as to provide the maximum adaptability of the apparatus to ground contours. The use of multiple, usually two, independently actuatable pusher bars enables the machine both to steer itself and to vary the closeness of engagement of the blocks across its width, so that divergence of the machine from a desired path of movement can be avoided, and the layer of blocks laid by it can be adapted to the contours of the ground to be covered with blocks.

Further features of the invention will become apparent from the following description of a preferred embodiment thereof.

SHORT DESCRIPTION OF THE DRAWINGS

In the drawings:

FIG. 1 is a perspective view of a machine in accordance with the invention, in use, FIG. 2 is a detail illustrating features of construction of the machine, FIGS. 3 and 4 are sections through earth banks, illustrating the utilization of the machine, and FIG. 5 schematically illustrates the pneumatic system of the machine.

DESCRIPTION OF THE PREFERRED EMBODIMENT

Figure 1:
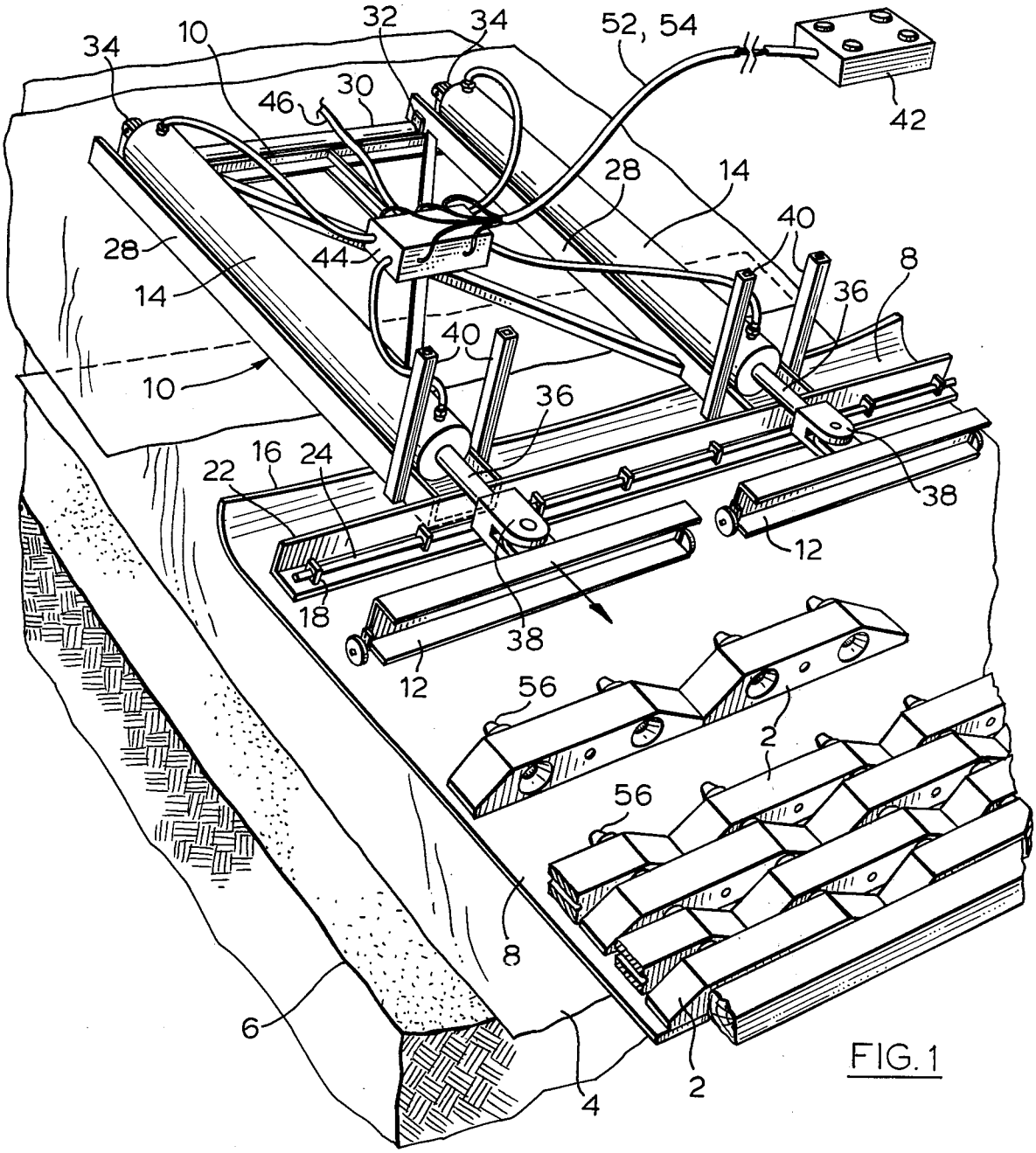
Figure 5:
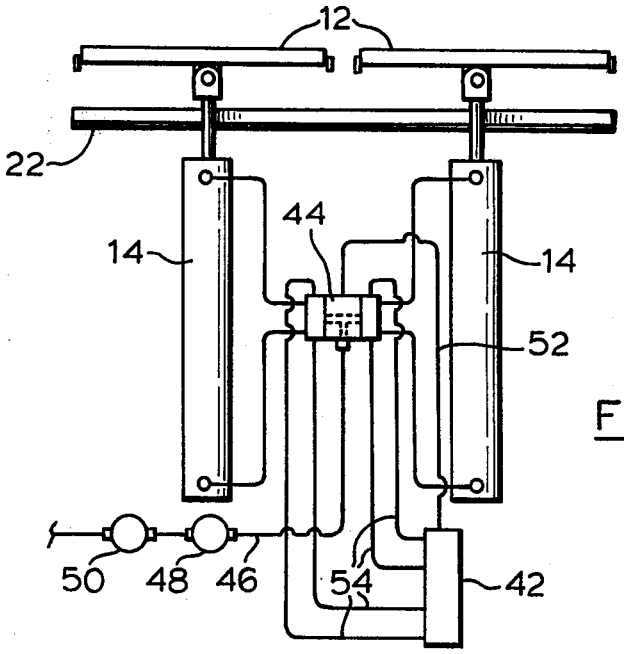

Referring to the drawings and particularly to FIG. 1, the machine of the invention is illustrated laying interlocking blocks 2 on a fibrous blanket 4 in accordance with the system described in Canadian Pat. No. 957,169. It should be understood however that the machine is equally applicable to the laying of other forms of block, either onto a blanket or onto any other form of underlying material such as loose sand or gravel, or plastic sheeting, which will either resist or is subject to damage by movement of the blocks thereover. The blanket 4 is illustrated as overlying an inclined bank 6, which may have a varying inclination as shown in FIG. 5, but it is a feature of the invention that the machine may be utilized to lay blocks over ground of any configuration upon which it is possible to lay the blocks in a stable and coherent layer.

The machine itself basically comprises an apron 8, a frame generally indicated at 10, two spaced pusher bars 12, and two spaced actuators 14 acting between the frame and the pusher bars 12.

Figure 2:
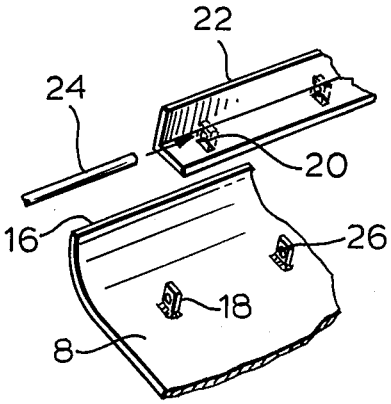
Figure 3:
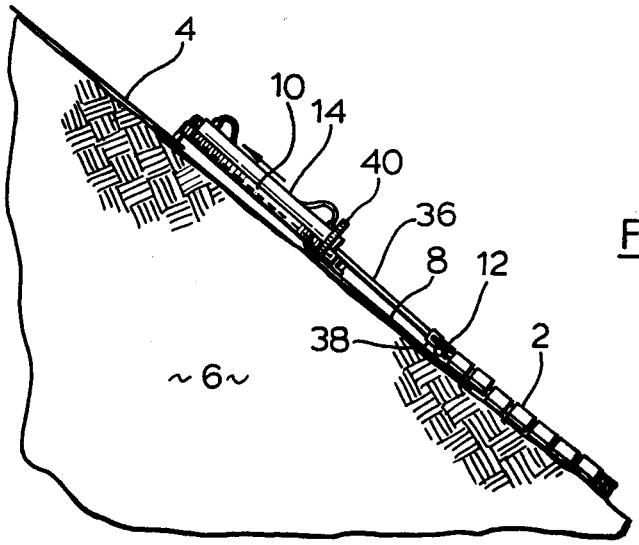

The apron is preferably a flexible stainless steel sheet, stainless steel being selected because of its resilience, strength, low frictional resistance to the blocks and the underlying material, and its resistance to corrosion. Other materials and structures would be possible, such as an apron of parallel rods as shown in U.S. Pat. No. 1,527,983, or parallel flexible strips of metal or high tensile low friction flexible plastics material. The forward marginal edge 16 of the apron is turned upward to avoid snagging against the blanket 4 and is linked to the frame by lugs 18 which pass through slots 20 in a front cross member 22 of the frame (see FIG. 2), to which they are releasably secured by a flexible rod 24 passed through apertures 26 in the lugs. This provides a connection which allows a measure of articulation and lateral flexure of the apron relative to the frame 10.

The frame 10 has two parallel spaced channel members 28 extending rearwardly from the front cross member, these being cross braced and supported at their rear ends by a roller 30 the height of which is adjustable by means of brackets 32. Also at the rear ends of the members 28 are vertically articulating connections 34 to the bodies of the actuators 14, which latter normally lie along the channel members.

The actuators are preferably double-acting pneumatic actuators, the piston rods 36 of which are secured to the pusher bars 12 by horizontally articulating connections 38. Pillars 40 restrain the bodies of the actuators against lateral motion whilst allowing them to pivot upwardly about the connections 34. The control system for the actuators is shown in FIG. 5. A control box 42 is connected by flexible air lines 52, 54 to a valve unit 44 which receives compressed air from a suitable source of supply through an air line 46 via conventional reduction and shut-off valves 48, 50. The valve unit 44 contains air-spool valves controlling the admission and exhaustion of air from the opposite side of the pistons within the actuators 14, so as to advance and withdraw the pusher bars 12 and to determine the pressure applied by the bars to blocks laid on the apron. The spool valves are themselves pneumatically operated by air directed to them through the lines 54 by independent manually operated pilot valves in the unit 42, which receives a supply of air on the line 52. An operator thus has fully independent control of the two actuators.

The pusher bars 12 are channel shaped to accommodate the spigots 56 on the blocks, and are supported by rollers so that they will move easily over the apron and engage at the correct level with the blocks 2.

In use, and instead of the blocks 2 being arranged directly on the filter mat 4, they are arranged on the apron 8 in successive courses built up from that side of the apron opposite the edge 16. When most of the apron has been covered, the control unit 42 is utilized to cause the piston rods 36 to be extended, pushing the pusher bars against the most recently laid course of blocks. Air pressure may be applied differentially to the two actuators to achieve various ends. Firstly, an increase of pressure may be applied first to one actuator and then the other, the reaction which results helping to shuffle the apron out from beneath the blocks. Secondly, the piston rods may be extended to different extents so as to steer the apparatus and orient it correctly to receive further courses of blocks. Thirdly, differential pressure may be utilized to move the blocks into different degrees of engagement on the two sides of the apron so as to compensate for the contour of the ground on which the blocks are laid. These capabilities of the machine mean that, unlike the known block laying machines, it can be operated to lay blocks over complex contours whilst maintaining correct alignment of both itself and the blocks. The procedure of laying courses of blocks and withdrawing the apron is repeated as many times as is necessary.

Figure 4:
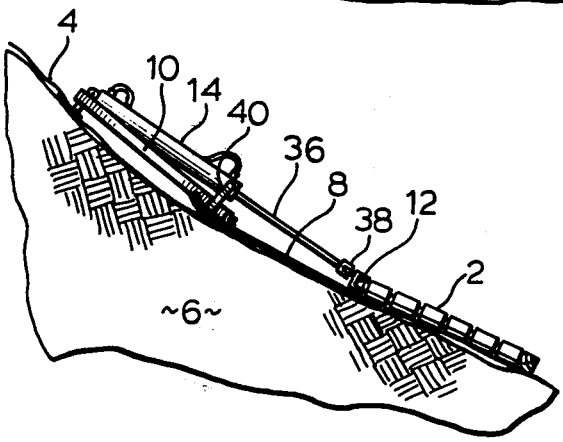

The various articulations between the parts already mentioned above assist in permitting the machine to be operated over complex contours. The form of connection between the apron 8 and the member 22, apart from permitting easy replacement of the apron should it be damaged, allows the apron to adapt itself to limited changes of contour across the width of the apron and also between the apron and the frame. The member 22 may itself be articulated if additional flexibility is needed. The connections 34 allow the machine to operate up concave slopes (see FIG. 4). The machine may operate to lay blocks right up to the top of a slope by providing a temporary ramp in line with the slope upon which the frame 10 may rest during the final stages of block laying. Although blocks will normally be laid so that successive courses are built up a slope, operation in other directions is possible provided that the blocks will not slide out of place during laying.

It will be appreciated that variations in the construction of the machine are possible. Although pneumatic actuators have been described, and are believed preferable in the damp and dirty environments in which the machine will commonly be used, the use of, for example, hydraulic or electric actuators is not excluded. The number of actuators and pusher bars could be greater than two although it is believed that any substantial advantage would usually be gained thereby. It would be possible to mount a vibrator unit on the frame to aid in settling the blocks into position and in withdrawal of the apron.

What I claim is:

1. A machine for laying interlocking blocks on a prepared surface comprising a thin, flexible, rectangular apron upon which successive courses of blocks may be laid extending parallel to and commencing at one marginal edge, said apron presenting a low frictional resistance to movement of the blocks over its upper surface and to movement of its lower surface over the prepared surface, a frame connected to a second marginal edge of the apron opposite said one marginal edge, at least two laterally spaced pusher bars overlying the apron and extending substantially parallel to said marginal edges, each pusher bar being engageable with a different part of the same course of blocks, a retractable actuator acting between each pusher bar and the frame and operable so as to push its associated bar and the frame apart, and means for operating each of said actuators independently.

2. A machine according to claim 1, wherein the actuators are independently controlled double acting pneumatic rams.

3. A machine according to claim 1 or 2, wherein the actuators are articulated to the frame for vertical pivotal movement, and to the pusher bars for horizontal pivotal movement.

4. A machine according to claim 3, wherein the apron is articulated to the frame.

5. A machine according to claim 4, wherein the apron is a flexible stainless steel sheet.

6. A machine according to claim 1, wherein the actuators and pusher bars are two in number.

* * * * *